US010682033B2

(12) United States Patent
Pisacane

(10) Patent No.: US 10,682,033 B2
(45) Date of Patent: Jun. 16, 2020

(54) ALL SURFACE CLEANROOM MOP

(71) Applicant: Foamtec International Co., Ltd., Oceanside, CA (US)

(72) Inventor: Ferdinand Frederick Pisacane, San Diego, CA (US)

(73) Assignee: Foamtec International Co., Ltd., Waco, TX (US)

( * ) Notice: Subject to any disclaimer, the term of this patent is extended or adjusted under 35 U.S.C. 154(b) by 98 days.

(21) Appl. No.: 14/469,845

(22) Filed: Aug. 27, 2014

(65) Prior Publication Data

US 2014/0359960 A1 Dec. 11, 2014

Related U.S. Application Data

(63) Continuation of application No. 13/341,954, filed on Dec. 31, 2011, now Pat. No. 8,844,089.

(60) Provisional application No. 61/429,031, filed on Dec. 31, 2010.

(51) Int. Cl.

| | |
|---|---|
| ***A47L 13/24*** | (2006.01) |
| ***A47L 13/20*** | (2006.01) |
| ***A47L 13/256*** | (2006.01) |
| ***A47L 13/44*** | (2006.01) |

(52) U.S. Cl.

CPC ..... *A47L 13/20* (2013.01); *A47L 13/24* (2013.01); *A47L 13/256* (2013.01); *A47L 13/44* (2013.01)

(58) Field of Classification Search

CPC ..... A47L 13/20; A47L 13/24; A47L 13/254; A47L 13/256

USPC ..... 15/147.2, 228, 231, 232, 209.1

See application file for complete search history.

(56) References Cited

U.S. PATENT DOCUMENTS

| | | | | |
|---|---|---|---|---|
| 3,099,855 | A * | 8/1963 | Nash | A47L 13/29 15/231 |
| 3,711,885 | A * | 1/1973 | Griffin | A47L 13/20 15/229.4 |
| 5,452,491 | A | 9/1995 | Thompson | |
| 6,367,121 | B1 | 4/2002 | MacMillan | |
| D461,028 | S * | 7/2002 | Ng | D32/40 |
| 7,028,364 | B2 | 4/2006 | Policicchio et al. | |
| 8,844,089 | B2 * | 9/2014 | Pisacane | 15/228 |
| 2003/0009839 | A1 * | 1/2003 | Streutker | A47L 13/24 15/228 |
| 2004/0128786 | A1 * | 7/2004 | Policicchio | A47L 13/20 15/228 |
| 2004/0206372 | A1 | 10/2004 | Holt et al. | |
| 2005/0011536 | A1 * | 1/2005 | Hofte | A47L 13/10 134/6 |

(Continued)

FOREIGN PATENT DOCUMENTS

| | | | | |
|---|---|---|---|---|
| EP | 1698262 | A3 * | 3/2009 | A47L 13/11 |

*Primary Examiner* — Shay Karls

(74) *Attorney, Agent, or Firm* — Zeman-Mullen & Ford, LLP

(57) ABSTRACT

A cleanroom mop for cleaning all critical surfaces within a cleanroom. The cleanroom mop includes a mop head frame with at least one hollow area within the mop head frame that is accessible by at least one opening located on the top of the mop head frame, a handle attached to the mop head frame, and a mop head that is attachable to the mop head frame which has opposing sides and at least one snap fastener on each of the opposing sides where the snap fasteners can be snapped together to connect the opposing sides of the mop head.

16 Claims, 16 Drawing Sheets

(56) References Cited

U.S. PATENT DOCUMENTS

| | | | | |
|---|---|---|---|---|
| 2005/0060827 | A1* | 3/2005 | James | A47L 13/42<br>15/144.2 |
| 2006/0000041 | A1 | 1/2006 | Streutker et al. | |
| 2009/0144926 | A1 | 6/2009 | Fava | |
| 2009/0223009 | A1 | 9/2009 | Nobile et al. | |

* cited by examiner

ALL SURFACE CLEANROOM MOP

CROSS-REFERENCE TO RELATED APPLICATIONS

This application is a continuation of and claims the benefit of, and priority to U.S. Nonprovisional patent application Ser. No. 13/341,954 filed Dec. 31, 2011, currently pending, which application claims the benefit of, and priority to, U.S. Provisional Application No. 61/429,031, filed Dec. 31, 2010, which applications are hereby incorporated by reference in their entirety.

FIELD OF INVENTION

The present invention is directed to a cleanroom mop for cleaning all types of surfaces, especially those surfaces present in a cleanroom environment for manufacturing and processing articles that has a low level of environmental pollutants such as dust, airborne microbes, aerosol particles and chemical vapors. More specifically, the present invention is directed to a cleanroom mop which includes a mop head frame with at least one hollow area within the mop head frame that is accessible by at least one opening located on the top of the mop head frame, a handle attached to the mop head frame, and a mop head that is attachable to the mop head frame which has opposing sides and at least one snap fastener on each of the opposing sides where the snap fasteners can be snapped together to connect the opposing sides of the mop head. The snapped together areas of the mop head can then be pushed through the openings located on the top of the mop head frame so that they are retained within the mop head frame thereby securing the mop head to the mop head frame.

BACKGROUND OF THE INVENTION

A cleanroom is an environment that is used to manufacture and/or process goods or articles that are sensitive to environmental contamination. For example, cleanrooms are used extensively in semiconductor and microelectronic manufacturing, biotechnology, optics, the life sciences and numerous other fields that require goods or articles to be manufactured or processed without environmental contamination.

In order to maintain the cleanroom environment, the critical surfaces contained within the cleanroom, such as the cleanroom's ceilings, walls and floors, must themselves be cleaned regularly in order to remove disinfectant residues. These types of surfaces are often cleaned with mop heads. However, these surfaces can be difficult to reach and the mop heads need to be easily replaced after becoming dirty in order to effectively and efficiently clean the cleanroom surfaces. Therefore, there is a need for a cleanroom mop and cleanroom mop head that facilitate easy, effective, and efficient cleaning of critical cleanroom surfaces such as the ceilings, walls and floors of a cleanroom. There is also a need for a cleanroom mop head that is easy to assemble and disassemble from the mop head frame in order to avoid cross contamination.

SUMMARY OF THE INVENTION

The present invention is directed to a cleanroom mop and cleanroom mop head for cleaning critical cleanroom surfaces. The cleanroom mop of the present invention includes a mop head frame having a top, a bottom, and at least one hollow area within the mop head frame that is accessible by at least one opening located on top of the mop head frame, and a handle attached to the mop head frame.

In one exemplary embodiment, the mop head frame may also include a neck extending from the top of the mop head frame where the handle is removably attached to the neck of the mop head frame. In another exemplary embodiment, the handle removably attached to the mop head frame may be telescoping or telescopic thereby allowing the handle to extend to a longer length, if required, for reaching critical surfaces of the cleanroom that must be cleaned. The telescopic handle can then be retracted to return the cleanroom mop to a more standard mop length. The telescopic handle may also include a quick release lever lock for extending and retracting the telescoping handle.

In yet another exemplary embodiment, the neck of the mop head frame of the present invention may include a lock member for locking the mop head frame in a horizontal position in relation to the handle when the handle is located in a vertical position thereby resulting in the mop head frame and the handle forming a ninety degree angle in relation to one another.

In still another exemplary embodiment, the mop head frame may include a removable press clip contained within each of the openings in the top of the mop head frame for securing a mop head to the mop head frame. A mop head can be secured to the mop head frame by pushing at least a portion of the mop head through the removable press clip into the hollow area of the mop head frame. In yet another exemplary embodiment, the removable press clip is comprised of a flexible material and is generally star shaped having a small open center and a plurality of slits extending from the small open center so that at least a portion of a mop head can be pushed or pressed through the small open center and slits of the removable press clip.

The present invention is also directed to a mop head and the mop head of the present invention has a generally rectangular shape with two opposing short sides and two opposing long sides and a plurality of snap fasteners located along the two opposing long sides wherein the snap fasteners can be snapped together to connect the two long opposing sides of the mop head. Further the mop head of the present invention can be fitted over the above described various embodiments of the mop head frame and then the snapped together areas of the mop head can be pressed or pushed through the openings (or the removable press clips contained in the openings) of the mop head frame into the hollow area of the mop head frame thereby securing the mop head to the mop head frame.

In one exemplary embodiment of the mop head of the present invention, the mop head may include a foam layer that is completely encased between a top layer and a bottom layer of polyester fabric. In another exemplary embodiment of the mop head of the present invention, the mop head may include a fine pore foam layer that is completely encased between a top layer and a bottom layer of cleanroom polyester fabric.

BRIEF DESCRIPTION OF THE DRAWINGS

The subject invention will hereinafter be described in conjunction with the appended drawing figures, wherein like numerals denote like elements.

DETAILED DESCRIPTION

Figure 1:
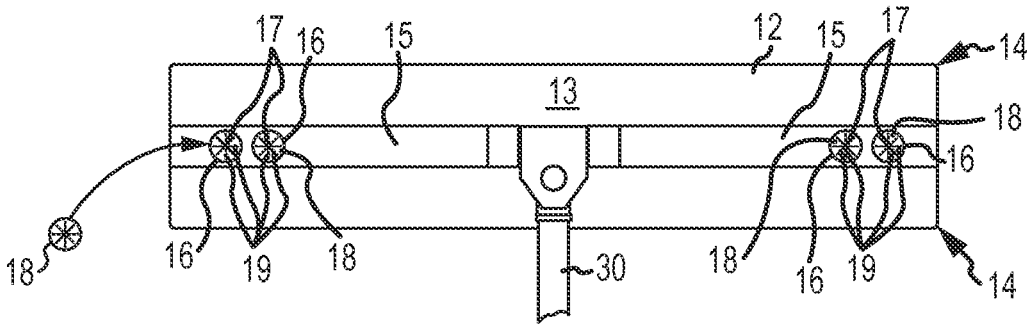
FIG. 1 is a top plan view of an exemplary mop head frame and partial handle of the cleanroom mop of the present invention.

A top plan view of one exemplary embodiment of the mop head frame 12 and partial handle 30 of the cleanroom mop 10 of the present invention is shown in FIG. 1. Mop head frame 12 comprises a generally rectangular shape that may have squared off ends 14 for enabling a user/operator to more easily access corners with the cleanroom mop 10. Frame 12 further includes a top 13, a bottom (not shown), and at least one hollow area (not shown) within the mop head frame 12 that is accessible by at least one opening 16. Mop head frame 12 is generally planar with a raised area 15 extending from the top 13 of the mop head frame 12. The hollow area (not shown) within the mop head frame 12 is located inside of this raised area 15.

Removable press clips 18 are inserted in the openings 16 located on top of raised area 15 of mop head frame 12 to aid in attaching and securing a mop head to the mop head frame 12. Removable press clips 18 may be flexible and may also have a generally star like shape with a small open center 17 and a plurality of slits 19 extending from the small open center 17.

Figure 2:
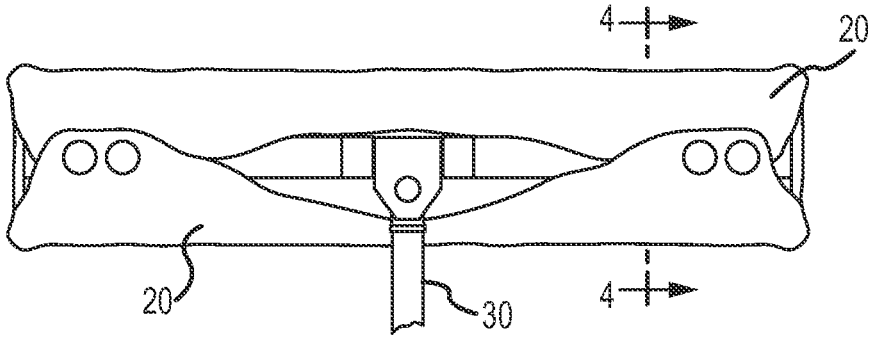
FIG. 2 is a top plan view of the mop head frame and partial handle shown in FIG. 1 with an exemplary mop head secured over the mop head frame.
Figure 2A:
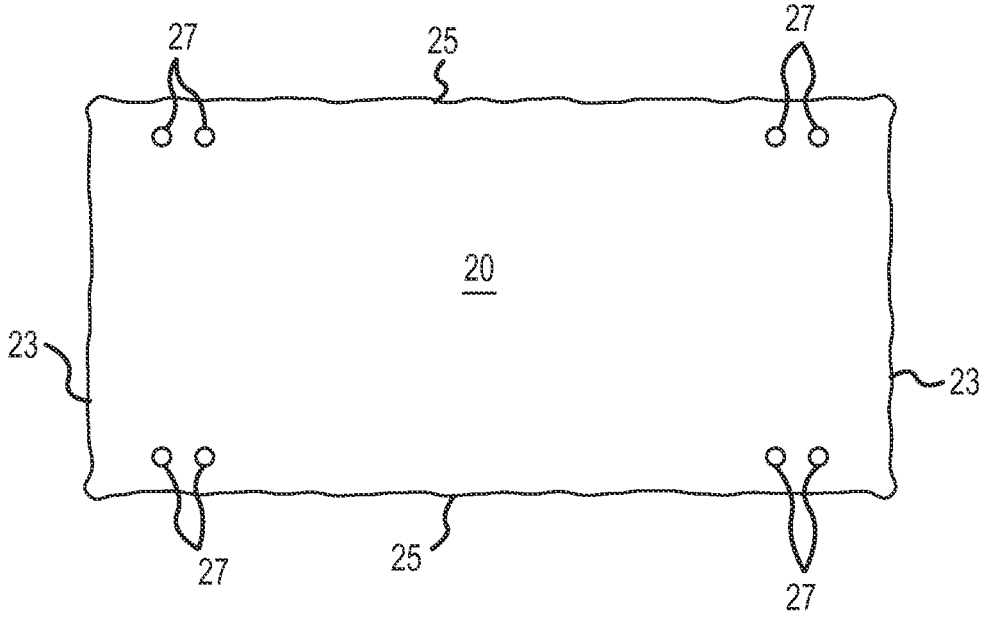
FIG. 2A is a top plan view of an exemplary mop head of the cleanroom mop of the present invention shown with sides unattached.

FIG. 2 is a top plan view of the mop head frame 12 and partial handle 30 shown in FIG. 1 with an exemplary mop head 20 secured over the mop head frame 12. FIG. 2A is a top plan view of an exemplary mop head 20 of the cleanroom mop of the present invention shown with sides unattached. Mop head 20 has a generally rectangular shape with two opposing short sides 23 and two opposing long sides 25 where opposing long sides 25 further include snap fasteners 27 for snapping the opposing long sides 25 together thereby creating a sleeve that fits over mop head frame 12. Once the mop head sleeve is positioned over the mop head frame 12, the snapped together areas of the mop head 20 are pressed or pushed through the removable press clips 18 contained in the openings 16 of the raised area 15 extending from the top 13 of the mop head frame 12 in order to attach and secure the mop head 20 to the mop head frame 12.

It should be noted that the ends of long opposing sides 25 of mop head 20 located nearest to short opposing sides 23 of mop head 20 may already be secured to one another by lamination using heat and pressure without adhesives while the rest of the length of long opposing sides 25 is open with pairs of snap fasteners positioned along the lengths to later attached the rest of the length of the long opposing sides 25 to one another. Alternatively, the entire lengths of the long opposing sides 25 may only be attached to one another with snap fasteners.

Figure 3:
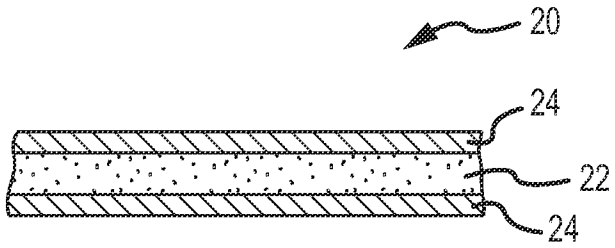
FIG. 3 is a partial cross-sectional view of an exemplary mop head that is designed to cover the mop head frame of the cleanroom mop of the present invention.

A partial cross-sectional view of an exemplary mop head 20 that is designed to cover the mop head frame 12 of the cleanroom mop 10 of the present invention is shown in FIG. 3. As shown in FIG. 3, mop head 20 comprises a foam layer 22 that is completely encased between two layers (a top layer and a bottom layer) 24 of polyester fabric. The foam layer 22 may comprise a fine pore foam layer and the top and bottom layers 24 may comprise layers of cleanroom polyester fabric. Fine pore foam layer 22 may be encased between cleanroom polyester fabric layers 24 by laminating the layers 24 of polyester fabric to the fine pore foam layer 22 using heat and pressure without the use of adhesives.

Figure 11:
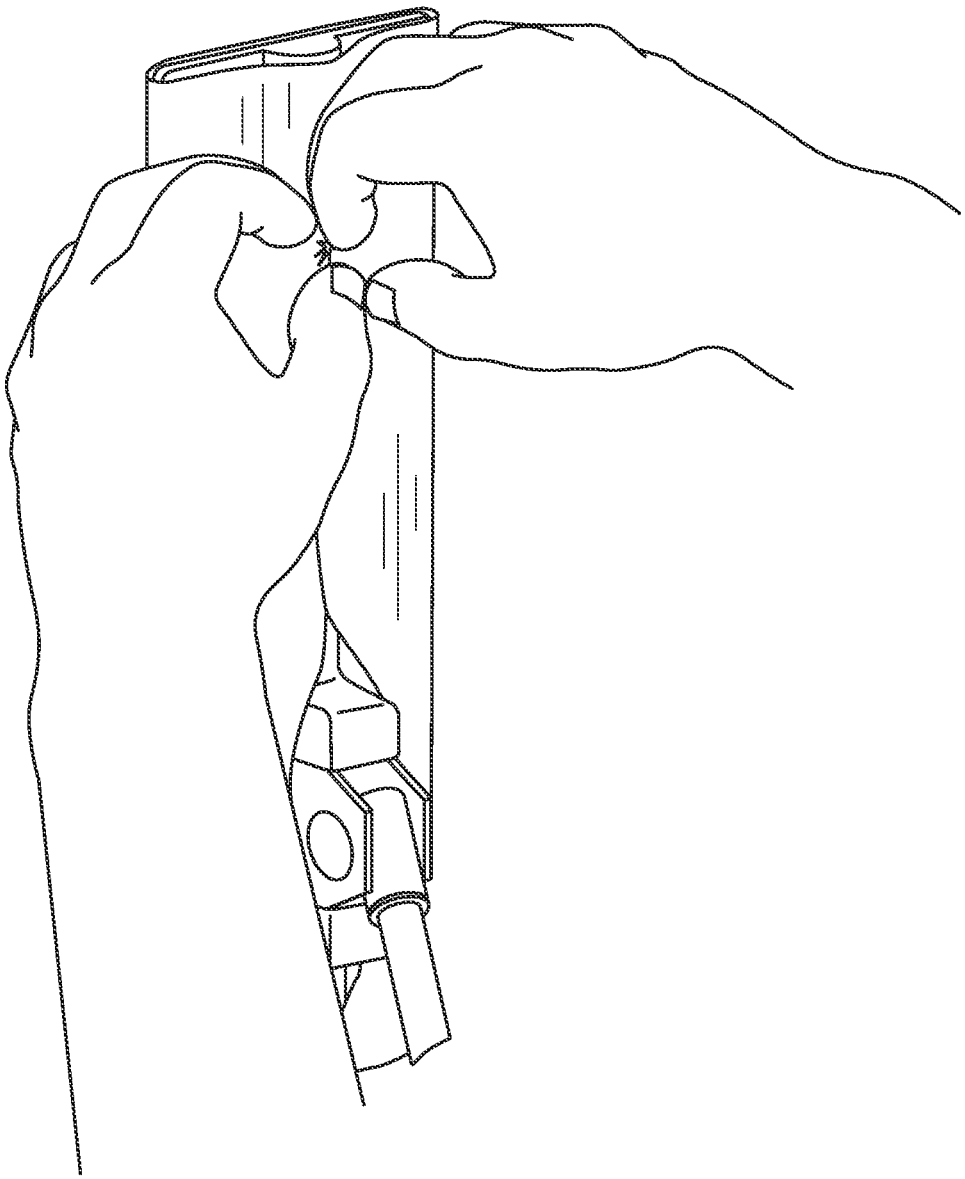

As previously explained above, exemplary mop head 20 is fitted over mop head frame 12 by snapping opposing long ends 25 of mop head 20 together over the mop head frame 12 (See FIG. 11). The mop head 20 is then secured to the mop head frame 12 by pressing or pushing the snapped together areas of the mop head 20 into the removable press clips 18 contained within the openings 16 of the mop head frame 12 (See FIG. 13).

Figure 4:
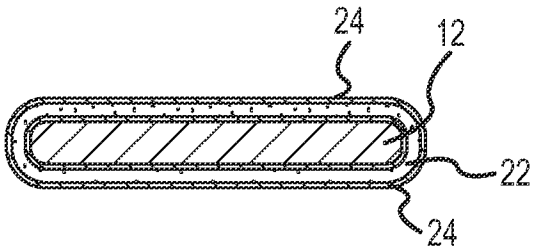
FIG. 4 is a cross-sectional view taken along lines 4-4 of FIG. 2.
Figure 5:
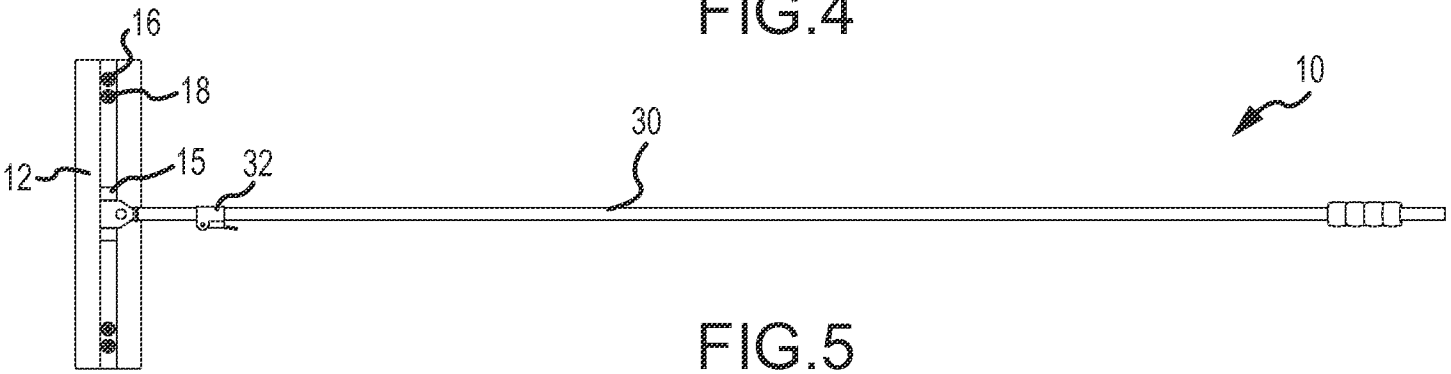
FIG. 5 is a top plan view of an exemplary embodiment of the cleanroom mop of the present invention.

A cross-sectional view taken along lines 4-4 of FIG. 2 is shown in FIG. 4. FIG. 4 shows mop head frame 12 of the cleanroom mop 10 of the present invention. FIG. 5 is a top plan view of an exemplary embodiment of the cleanroom mop 10 of the present invention. FIG. 5 shows mop head frame 12 attached to a telescoping handle 30 with a quick release lever lock 32 for extending and retracting the telescoping handle 30.

Figure 6:
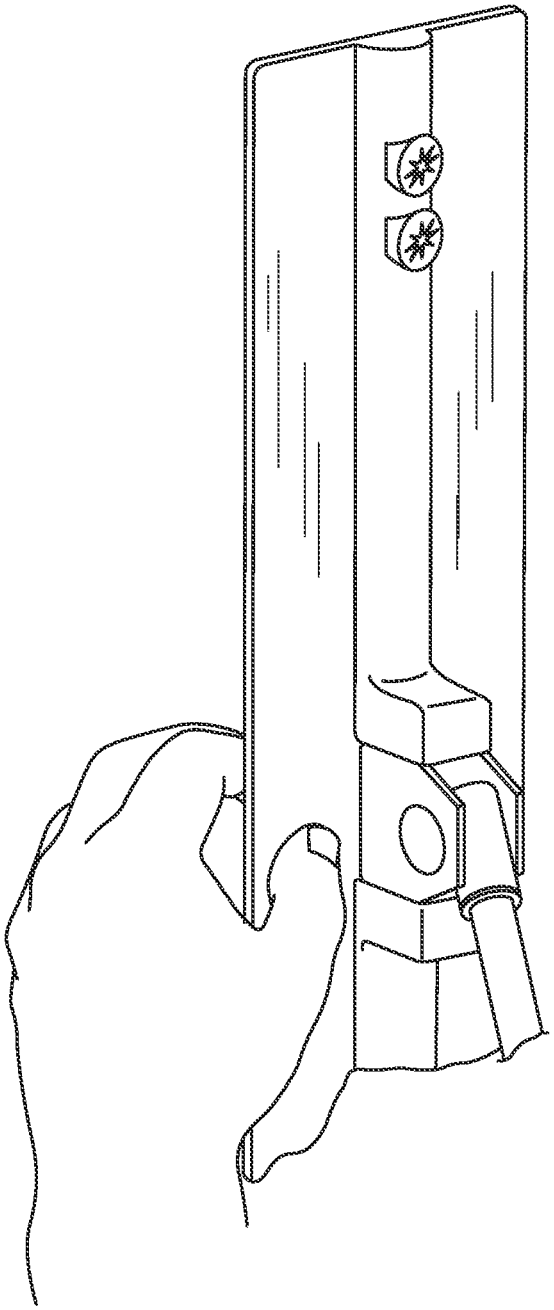
FIGS. 6-14 are perspective views showing how to apply the mop head of the cleanroom mop of the present invention to the mop head frame of the cleanroom mop of the present invention.
Figure 7:
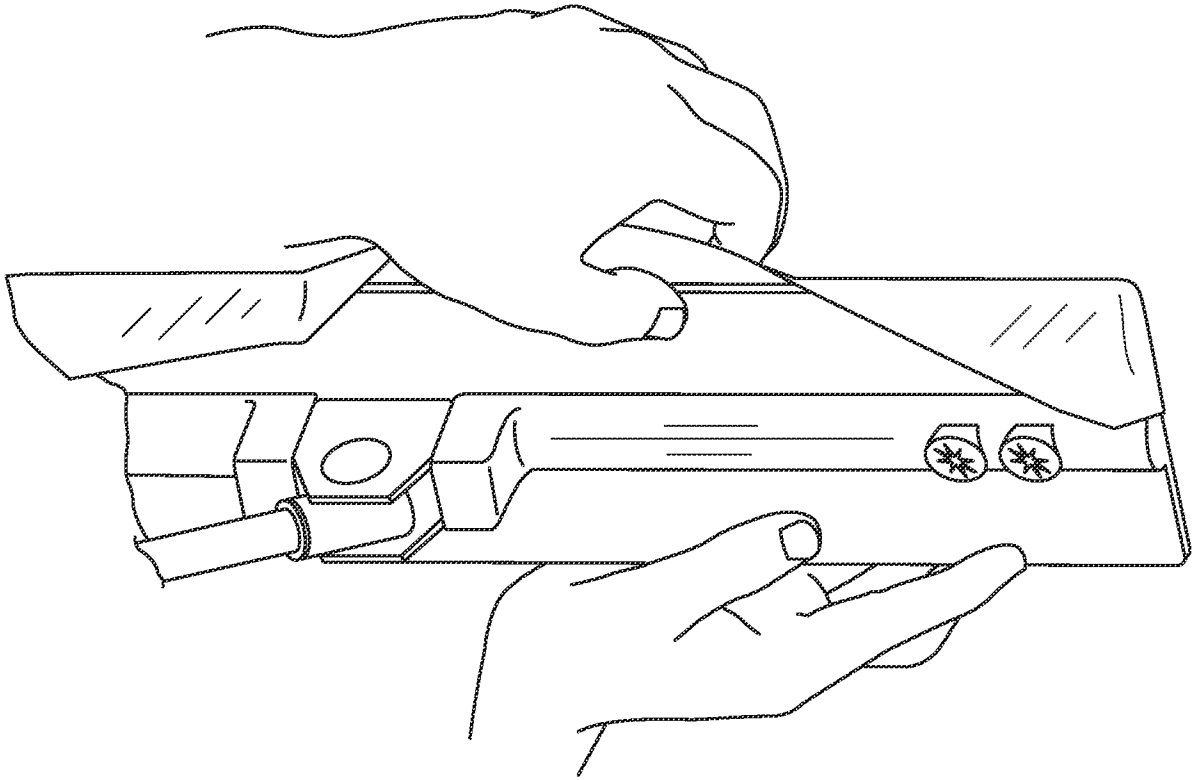
Figure 8:
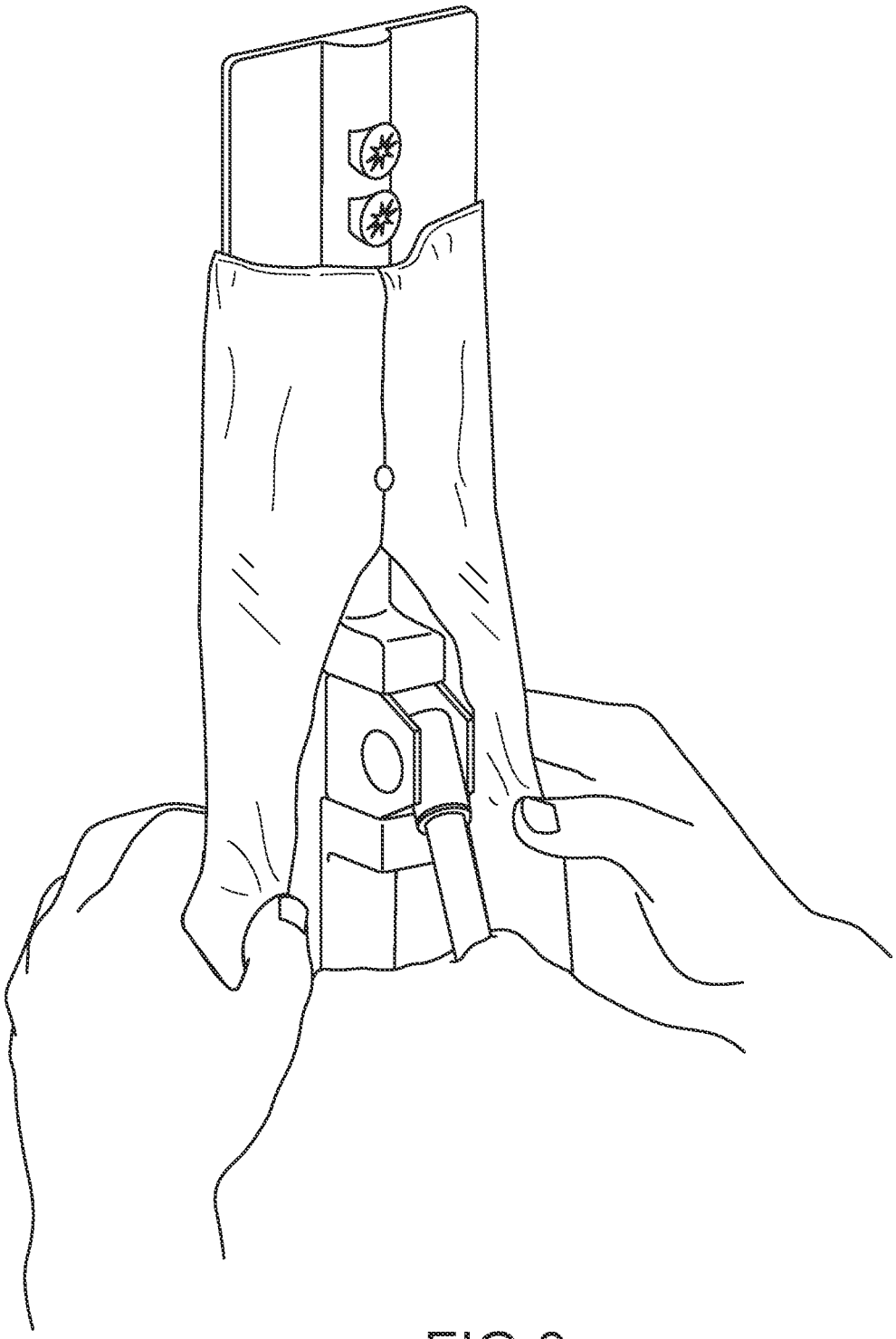
Figure 9:
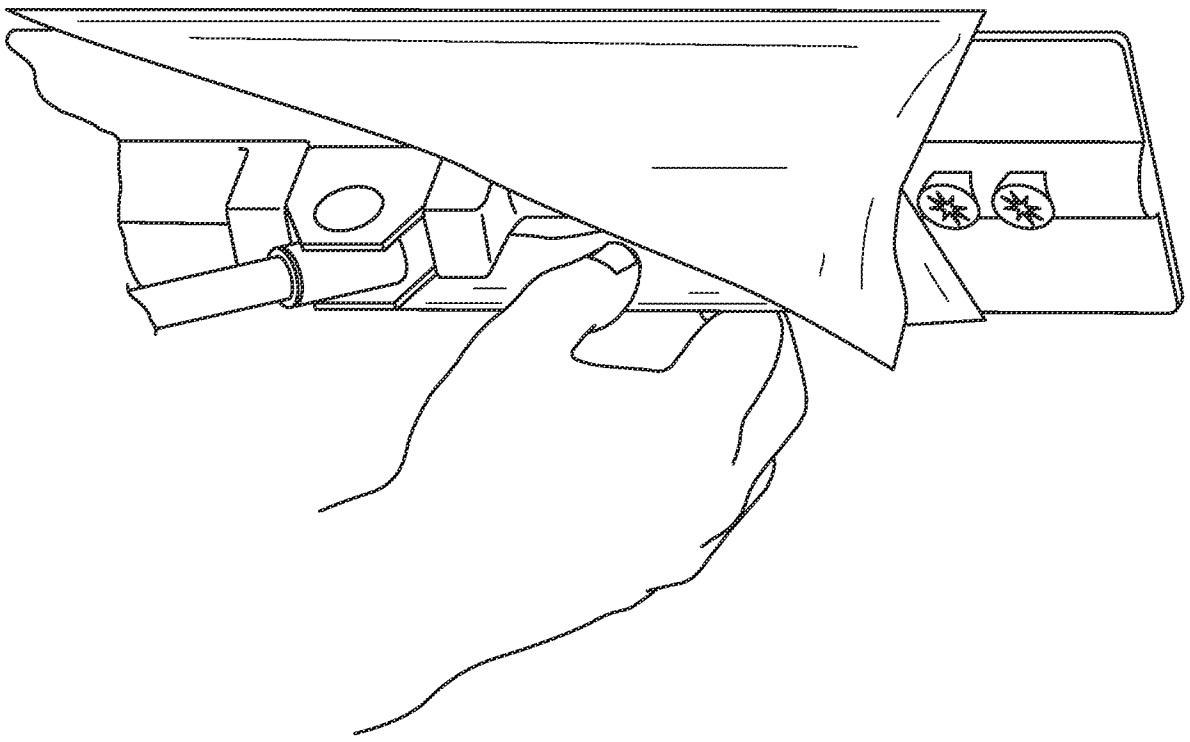
Figure 10:
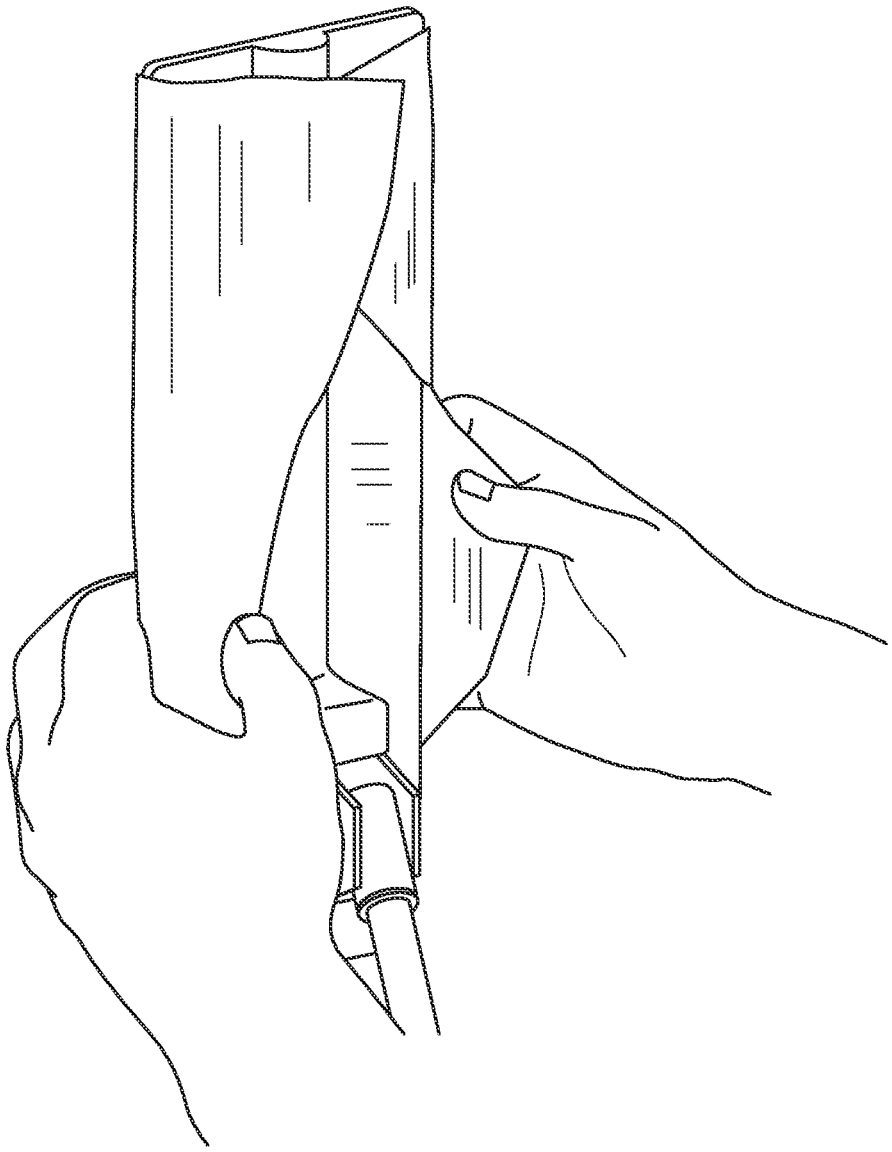
Figure 12:
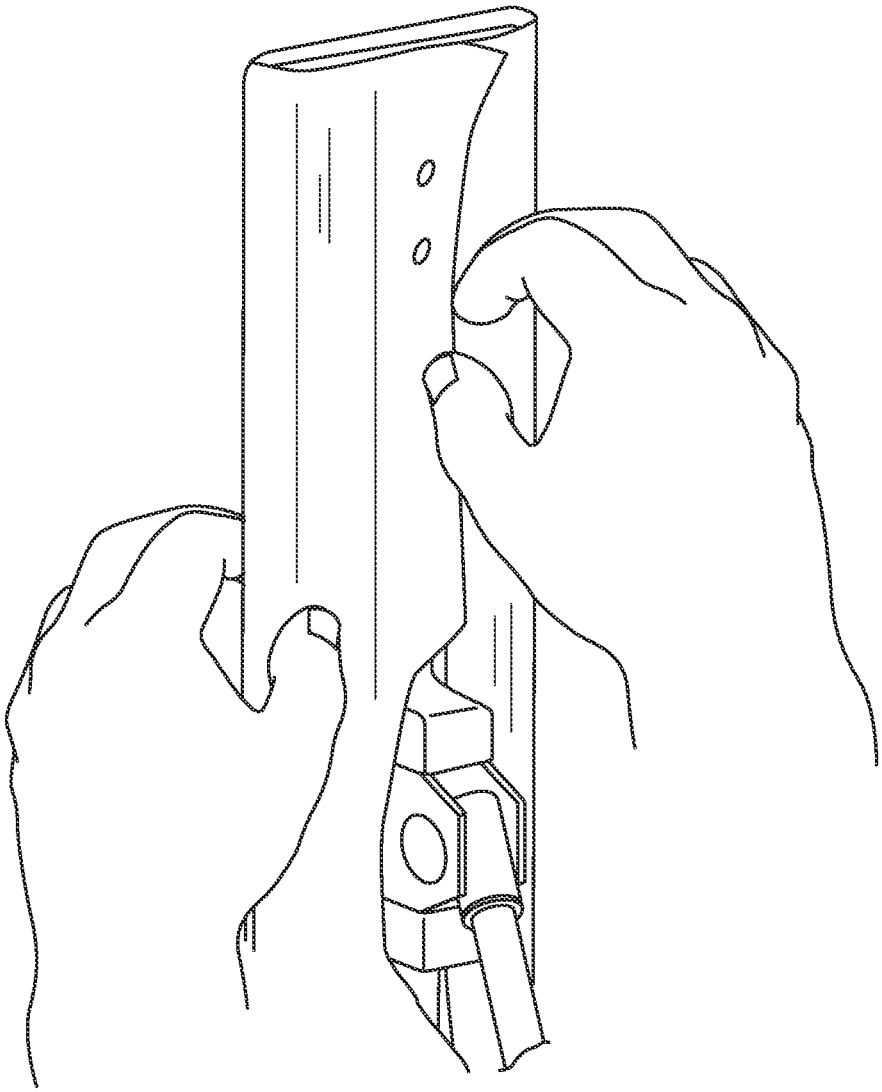
Figure 13:
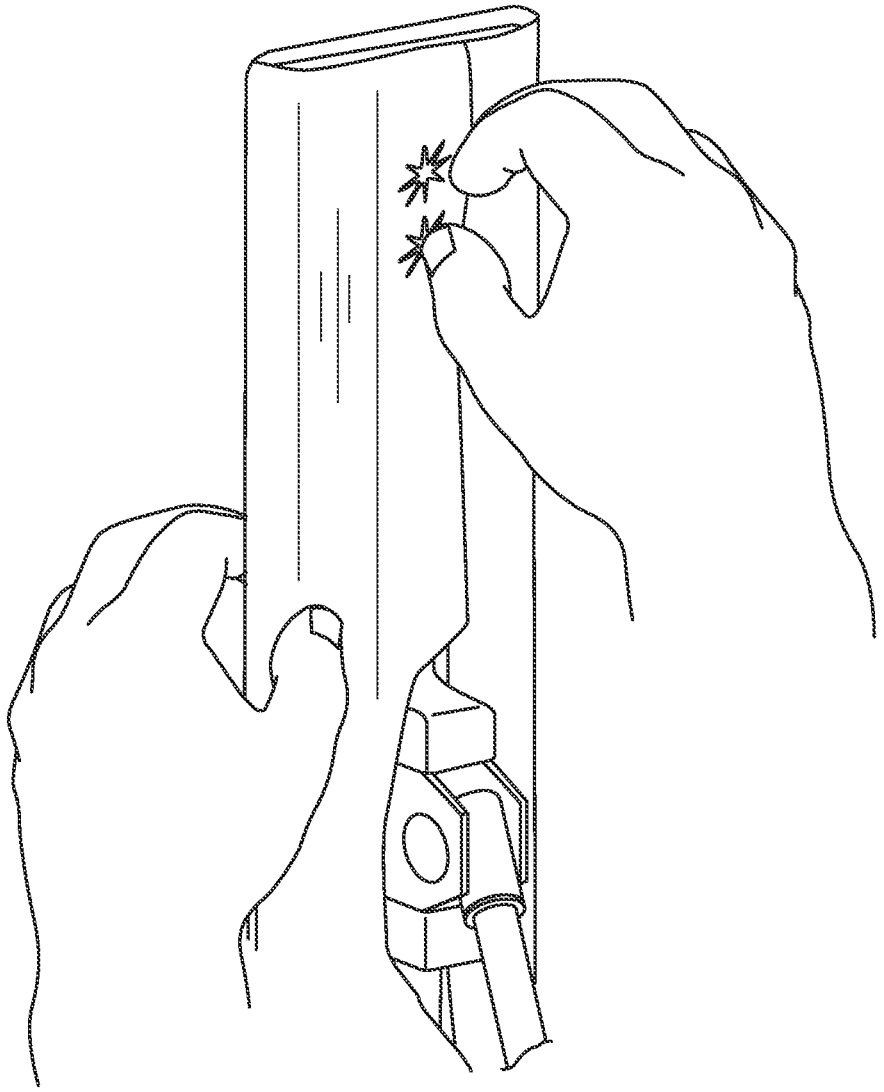
Figure 14:
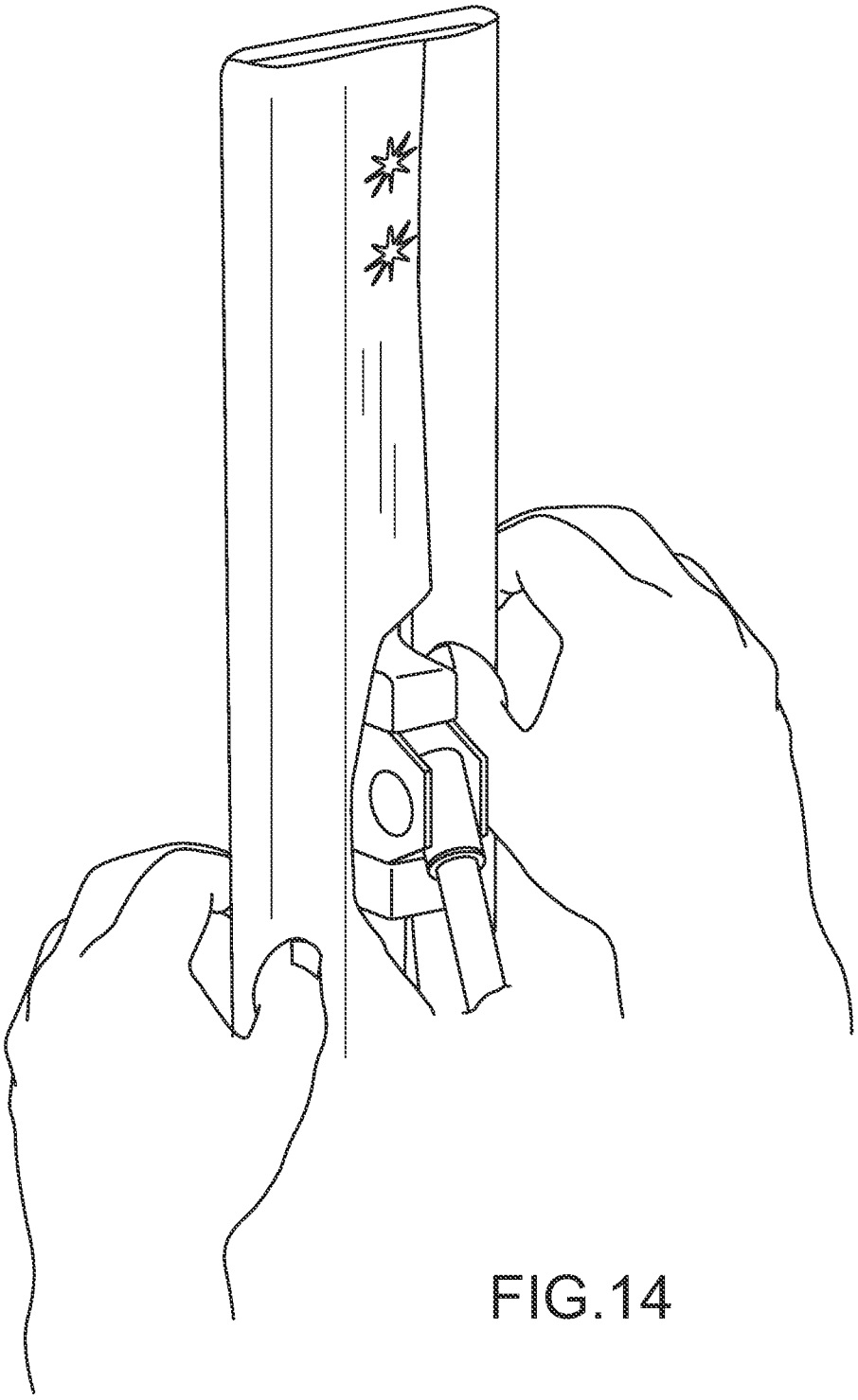

FIGS. 6-14 are perspective views showing how to apply the mop head 20 of the cleanroom mop 10 of the present invention to the mop head frame 12 of the cleanroom mop 10 of the present invention. In FIG. 6, a user/operator holds the mop head frame 12 in a vertical position while holding the handle 30 in a vertical position. The user/operator then snaps together a first pair of snap fasteners 27 contained on opposing long sides 25 of mop head 20 and then slides the snapped together portion of the mop head 20 over the mop head frame 12 as shown in FIGS. 7 and 8. Then, as shown in FIGS. 9 and 10, the user/operator slides the mop head 20 vertically upward along the mop head frame 12 to correctly position the mop head 20 over the mop head frame 12. The user/operator then snaps another pair of snap fasteners 27 together that are located on the long opposing sides 25 of the mop head 20 as shown in FIGS. 11 and 12. Next, as shown in FIG. 13, the snapped together area of the mop head 20 is pressed or pushed through the removable press clip 18 contained within the openings 16 of the mop head frame 12. FIG. 14 shows the mop head 20 being further adjusted and positioned for the remaining snap fasteners 27 on the mop head 20 to be snapped together and pushed through removable press clips 18 contained within openings 16 of mop head frame 12.

Figure 15:
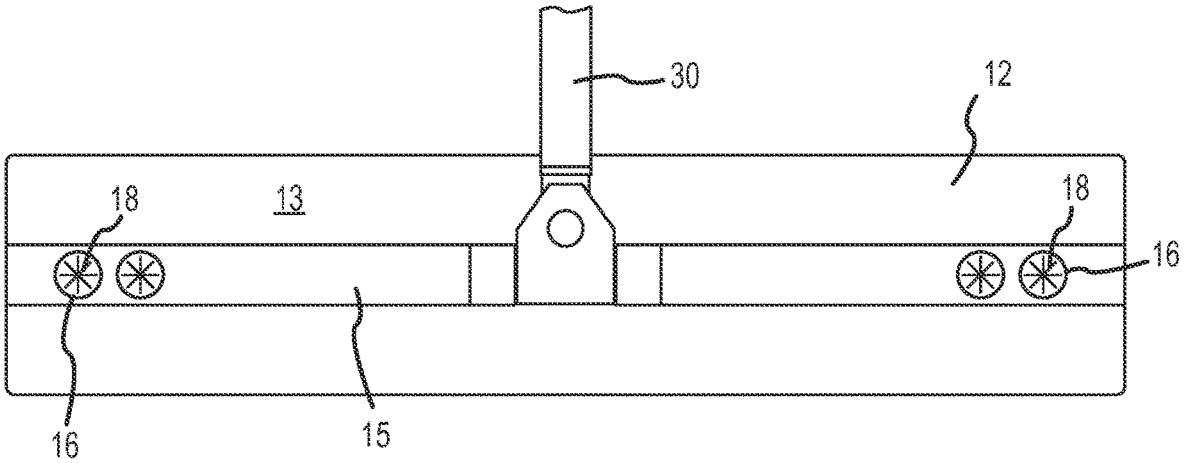
FIG. 15 is a top plan view of the mop head frame of the cleanroom mop of the present invention shown connected to the handle of the cleanroom mop of the present invention.
Figure 16:
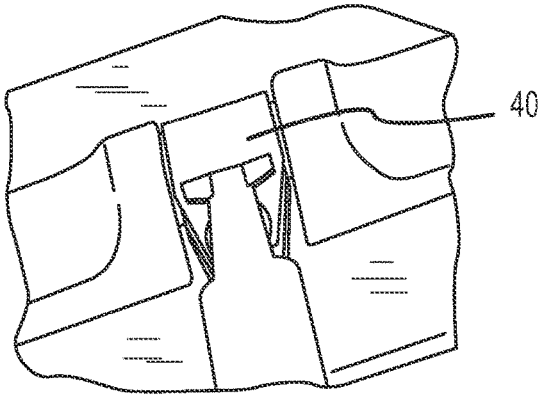
FIG. 16 is an enlarged view of the locking device or lock member installed on the mop head frame shown in a locked position.
Figure 17:
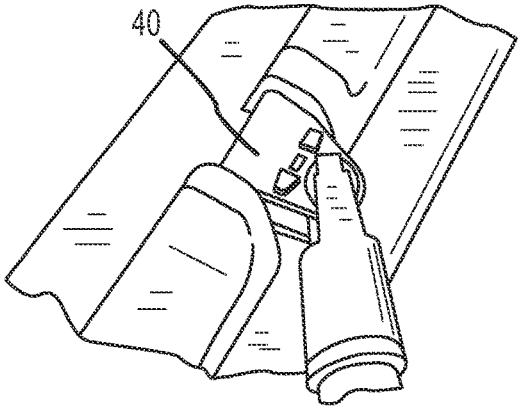
FIG. 17 is an enlarged view of the locking device or lock member installed on the mop head frame shown in an unlocked position.

FIG. 15 is a top plan view of the mop head frame 12 of the cleanroom mop of the present invention shown connected to the handle 30 of the cleanroom mop of the present invention. As shown in FIG. 15, the ends of the mop head frame 12 have been "squared off" enabling the user/operator to more easily access corners of cleanroom surfaces while cleaning. FIG. 16 is an enlarged view of the locking device or lock member 40 installed on the mop head frame shown in a locked position and FIG. 17 is an enlarged view of the locking device or lock member 40 installed on the mop head frame shown in an unlocked position. The lock member 40 functions to lock the mop head frame 12 in a horizontal position in relation to the handle when the handle is in a vertical position so that the cleanroom mop 20 can be used more efficiently and effectively for cleaning surfaces such as the walls of a cleanroom. When the lock member 40 is in the unlocked position, the cleanroom mop 20 will maintain a swivel motion that is most often used for cleaning the floors of a cleanroom.

Figure 18:
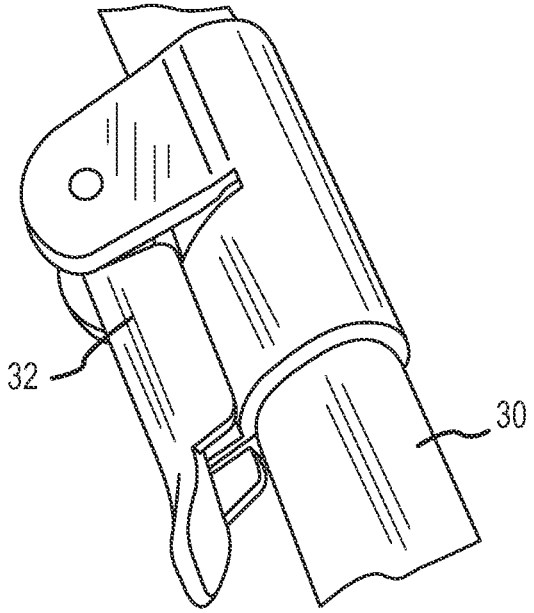
FIG. 18 is an enlarged view of a quick release lever lock located on the handle of the cleanroom mop of the present invention shown in a locked position.
Figure 19:
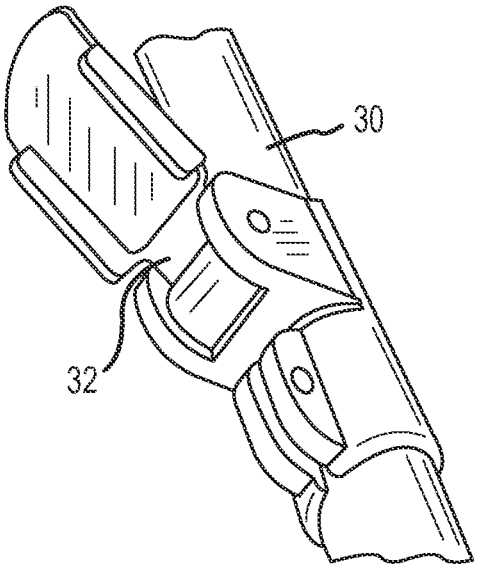
FIG. 19 is an enlarged view of a quick release lever lock located on the handle of the cleanroom mop of the present invention shown in an unlocked position.

FIG. 18 is an enlarged view of a quick release lever lock 32 located on a telescoping handle 30 of the cleanroom mop of the present invention shown in a locked position and FIG. 19 is an enlarged view of a quick release lever lock 32 located on a telescoping handle 30 of the cleanroom mop of the present invention shown in an unlocked position. The lever lock 30 is installed on the telescoping handle 30 to allow for quickly and easily extending and retracting the telescoping handle. In addition, extenders (not shown) may also be attached to the handle 30 in order to further extend the handle 30 of the cleanroom mop 10 of the present invention.

Figure 20:
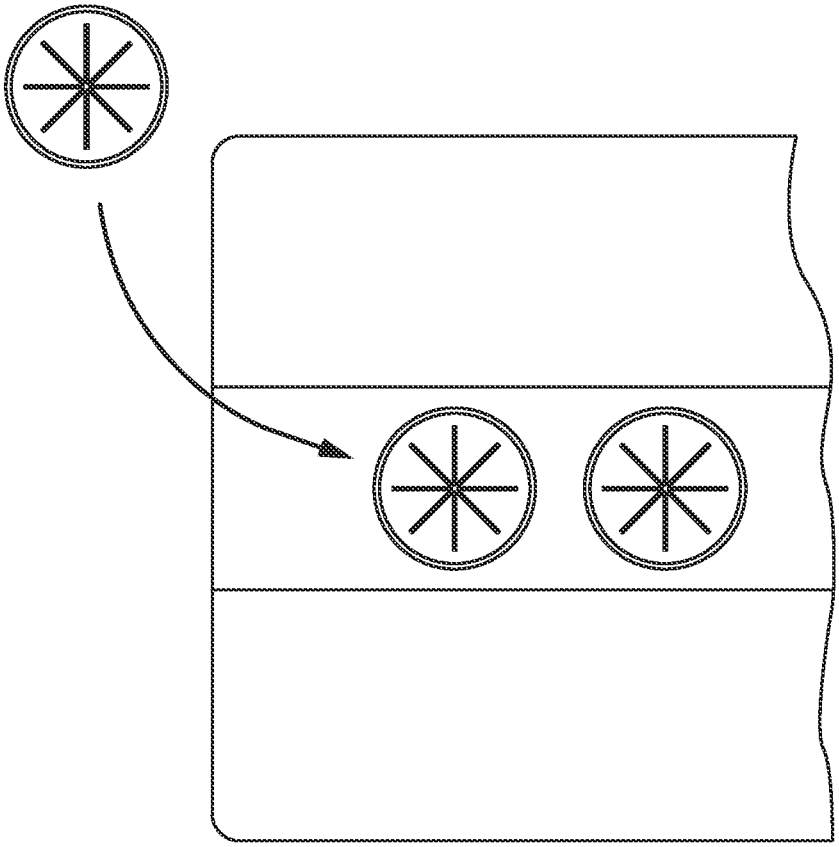
FIG. 20 is an enlarged view of the removable press clips positioned in the openings on the top of the mop head frame.

FIG. 20 is an enlarged view of the removable press clips 18 positioned in the openings 16 on the top of the mop head frame 12. The removable press clips 18 may be flexible and generally star shaped and can be removed and replaced if damaged without having to replace the entire mop head frame 12.

Figure 21:
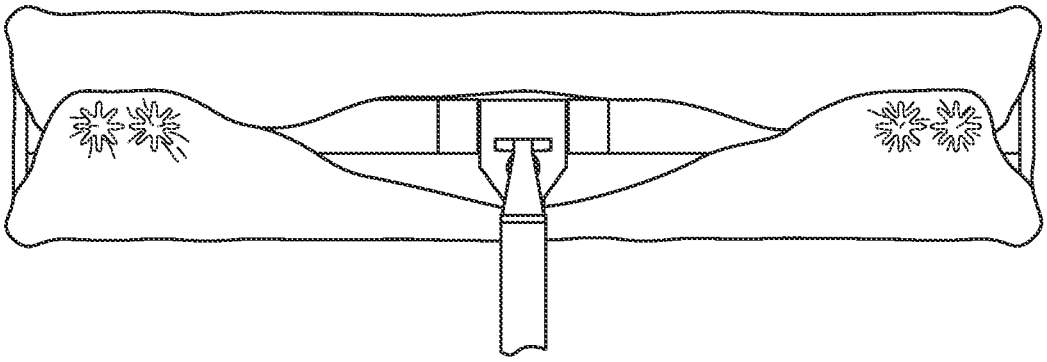
FIG. 21 is a top plan view of the mop head of the present invention shown secured to the mop head frame of the present invention with the handle of the cleanroom mop shown attached to the mop head frame.

FIG. 21 is a top plan view of the mop head 20 of the present invention shown secured to the mop head frame 12 of the present invention with the handle 30 of the cleanroom mop shown attached to the mop head frame 12. Extra sets of snap fasteners 27 may be added to mop head 20 to facilitate a better fit on the mop head frame 12.

Figure 22:
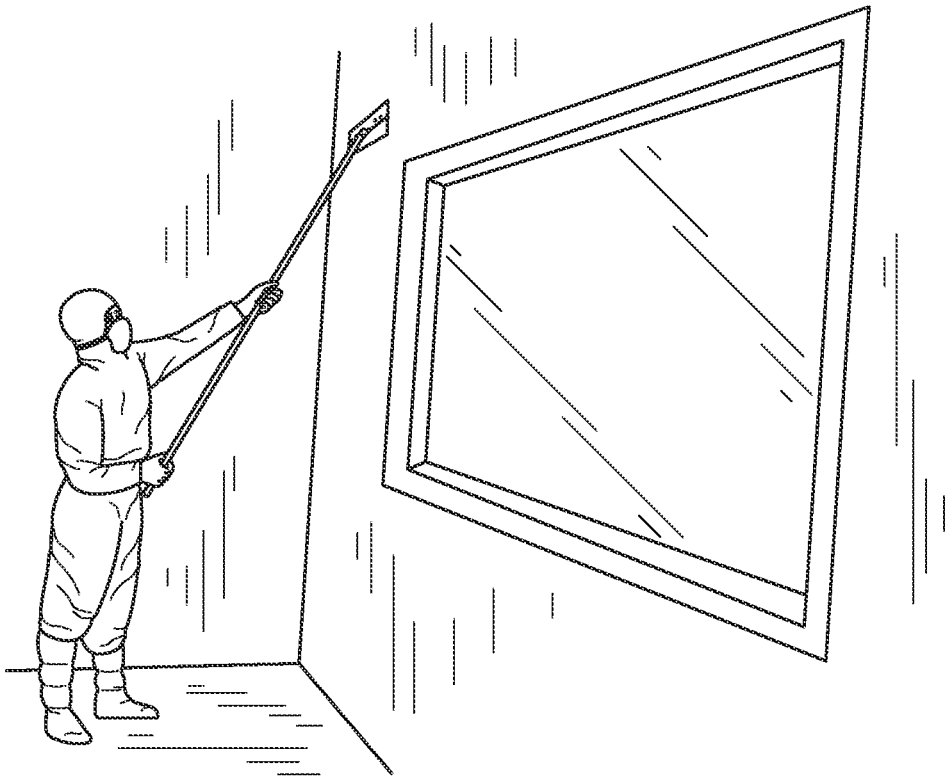
FIG. 22 is a schematic showing the cleanroom mop of the present invention being used on the wall of a cleanroom.
Figure 23:
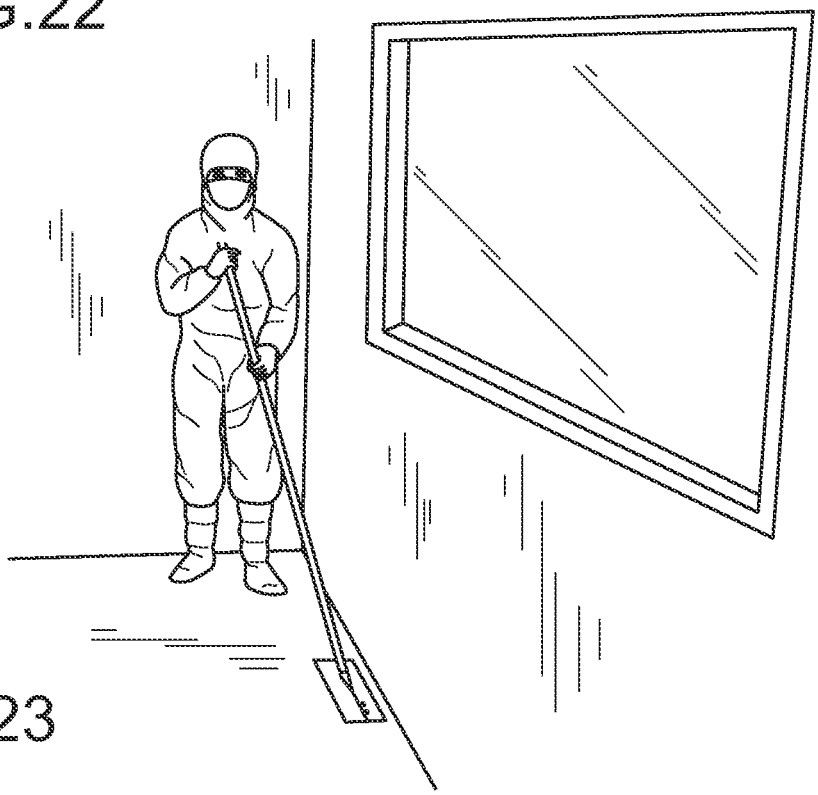
FIG. 23 is a schematic showing the cleanroom mop of the present invention being used on the floor of a cleanroom.

FIG. 22 is a schematic showing the cleanroom mop of the present invention being used on the wall of a cleanroom and FIG. 23 is a schematic showing the cleanroom mop of the present invention being used on the floor of a cleanroom.

Exemplary Features and Advantages of the cleanroom mop of the present invention include:

- The cleanroom mop of the present invention includes a two direction 360 degree swivel and a 1.5 inch low profile design which enables unsurpassed access to tight spaces thereby reducing deadspots.
- The mop head of the cleanroom mop features a construction technology with a super fine pore foam completely encased between two layers of clean room polyester fabric for unsurpassed fiber and particle control.
- The mop head of the cleanroom mop has an abrasion resistant cleanroom fabric over foam construction and class 100 processing that ensures fiber-free mopping of rough, non-skid floors in aseptic rooms.
- The cleanroom mop of the present invention has an all surface, large area design that is compatible with pull and figure eight motions, thereby simplifying SOPs and reducing costs by eliminating the need for multiple mop types.
- The cleanroom mop of the present invention is sterile and manufactured in an International Standards Organization (ISO) certified facility to ease validation testing.
- The cleanroom mop of the present invention has an ultra lightweight telescoping handle and extensions that reduce user/operator fatigue and cleaning time for high spaces.
- The mop head of the cleanroom mop may have a micro fiber fabric to enhance the cleaning of bleach and other disinfectants that leave heavy residues.
- The materials which comprise the cleanroom mop are compatible with the most aggressive disinfectants and sporicides including Vesphene, LpH, bleach, peracetic acid and Spor Klenz formulations.
- The mop head of the cleanroom mop may be extra thick to meet SOP requirements for extra long contact times when disinfecting spores.

The detailed description of exemplary embodiments of the invention herein shows various exemplary embodiments and the best modes, known to the inventor at this time, of the invention. These exemplary embodiments and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those reasonably skilled in the art. Additionally, all included figures are non-limiting illustrations of the exemplary embodiments and modes, which similarly avail themselves to any equivalent modes or embodiments that are known or obvious to those reasonably skilled in the art.

Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters, or other operating requirements without departing from the scope of the instant invention and are intended to be included in this disclosure.

The invention claimed is:

1. A clean room mop head comprising:

a mop head frame having a top, a bottom, a neck extending from the top of the mop head frame which includes a locking member that enables the neck to have a two direction 360-degree swivel in relation to the mop head frame, at least one raised area extending from the top of the frame such that it forms a half cylindrical shaped hollow area having a width less than half of a width of the frame, and at least one opening located on the top of the half cylindrical shaped hollow area wherein said at least one opening is in vertical alignment with said neck; and a mop head having a generally rectangular shape with two opposing short sides and two opposing long sides and at least one snap fastener positioned adjacent to and along the two opposing long sides such that said at least one snap fastener is in alignment with said at least one opening located on the top of the mop head frame so that said at least one snap fastener can be snapped together and pushed into said at least one opening on the top of the half cylindrical shaped hollow area.

2. The clean room mop head of claim 1 further comprising a removable press clip contained within each of the at least one openings on the top of the half cylindrical shaped hollow area for securing the mop head to the mop head frame.

3. The clean room mop head of claim 2 wherein the removable press clip is flexible and generally star shaped having a small open center and a plurality of slits extending from the small open center.

4. The clean room mop room head of claim 1 wherein the mop head comprises a foam layer completely encased between a top layer and a bottom layer of polyester fabric.

5. The clean room mop room head of claim 4 wherein the foam layer comprises a fine pore foam layer and the top and bottom layers of polyester fabric comprise clean room polyester fabric.

6. The clean room mop room head of claim 1 wherein the mop head frame comprises a generally rectangular shape.

7. A clean room mop head comprising:

a mop head frame having a top, a bottom, a neck extending from the top of the mop head frame which includes a locking member that enables the neck to have a two direction 360-degree swivel in relation to the mop head frame, and at least one hollow area extending from a center of the top of the mop head frame to an end of the mop head frame wherein the hollow area has a width less than half of a width of the frame and wherein the hollow area is accessible by at least one opening located on a top of the hollow area and wherein said at least one opening is in vertical alignment with said neck; and a mop head having a generally rectangular shape with two opposing short sides and two opposing long sides and at least one snap fastener positioned adjacent to and along the two opposing long sides such that said at least one snap fastener is in vertical alignment with said at least one opening on the top of the mop head frame when said at least one snap fastener is snapped together thereby enabling the snapped together area of the mop head to be pushed into said at least one opening on the top of the mop head frame to secure the mop head to the mop head frame.

8. The clean room mop head of claim 7 further comprising a removable press clip contained within each of the at least one openings on the top of the hollow area for securing the mop head to the mop head frame.

9. The clean room mop head of claim 7 wherein the mop head comprises a foam layer completely encased between a top layer and a bottom layer of polyester fabric.

10. The clean room mop head of claim 9 wherein the foam layer comprises a fine pore foam layer and the top and bottom layers of polyester fabric comprise clean room polyester fabric.

11. A clean room mop comprising:

a mop head frame having a top, a bottom, and at least one opening located on the top of the mop head frame, and a locking member that enables a neck extending from the top of the mop head frame to have a two direction 360-degree swivel in relation to the mop head frame; and a mop head having a generally rectangular shape with two opposing short sides and two opposing long sides and at least one snap fastener positioned adjacent to and along the two opposing long sides wherein ends of the two opposing long sides located nearest to the two opposing short sides are secured to one another by lamination.

12. The clean room mop of claim 11 wherein the mop head frame has a height of 1.5 inches.

13. The clean room mop of claim 11 further comprising a telescoping handle having a quick release lock for extending and retracting the telescoping handle.

14. A rectangular shaped planar mop head frame having a top, a bottom, a locking member that enables a neck extending from the top of the mop head frame to have a two direction 360-degree swivel in relation to the mop head frame; and at least one raised area extending from the top of the frame such that it forms a half cylindrical shaped hollow area that extends from a middle of the top of the frame to an end of the top of the frame and that has a width less than half of a width of the mop head frame.

15. The mop head frame of claim 14 wherein the mop head frame has a height of 1.5 inches.

16. The mop head frame of claim 14 further comprising a telescoping handle having a quick release lock for extending and retracting the telescoping handle.

* * * * *